United States Patent [19]

Neuhierl

[11] 4,366,374

[45] Dec. 28, 1982

[54] LAP COUNTER FOR RADIO CONTROLLED VEHICLES

[76] Inventor: Hermann Neuhierl, Waldstrasse 36, D-8510 Fürth/Bayern, Fed. Rep. of Germany

[21] Appl. No.: 229,011

[22] Filed: Jan. 27, 1981

[30] Foreign Application Priority Data

Jan. 30, 1980 [DE] Fed. Rep. of Germany ..... 3003212

[51] Int. Cl.[3] ..... G07C 9/00

[52] U.S. Cl. ..... 235/93; 235/91 PR; 235/109; 235/111

[58] Field of Search ..... 235/1 C, 93, 95, 98 R–98 B, 235/99 R, 99 A, 142, 92 T, 91 PR, 91 D, 109, 111; 116/29

[56] References Cited

U.S. PATENT DOCUMENTS 2,675,964 4/1954 Berezny ..... 235/99 A 3,228,600 1/1966 May ..... 235/99 R

*Primary Examiner*—Benjamin R. Fuller

*Attorney, Agent, or Firm*—Scully, Scott, Murphy & Presser

[57] ABSTRACT

A lap counter for free running radio controlled toy vehicles includes two edge members which together define a convergent section of track and one or more counting devices on one or both sides of the convergent section of track. Each counting device includes two or more counting stations each of which has an actuating member associated with it positioned to be contacted by a trigger member carried by a vehicle. The actuating members of each counting device are arranged at different heights and connected to a respective one or two indicator arms which indicate the number of laps driven by a vehicle.

5 Claims, 8 Drawing Figures

LAP COUNTER FOR RADIO CONTROLLED VEHICLES

BACKGROUND OF THE INVENTION

The invention relates to a lap counter for radio controlled vehicles.

Radio controlled vehicles enjoy a considerable popularity. They are controlled by the "driver" by means of a radio transmitting device. In general, one, two or even more functions may be controlled. Normally the driving direction and also the speed are controlled.

Good radio controlled vehicles have a proportional control of the driving direction which enables the negotiation of curves of any desired radius. A further function which may be proportionally controlled is the speed, both backwards and forwards. Over and above these two functions it is possible to control other functions of such a toy vehicle in a manner similar to that of full size vehicles.

Even though such radio controlled vehicles arouse a particular fascination it has not previously been possible to record the driving performance of a driver.

By contrast, there are many ways of measuring the performance, i.e. the number of laps driven, with toy vehicles that are connected to a track. Such measuring is easily possible in this case since the current supply to the vehicles occurs via portions of the track.

Radio controlled vehicles have the disadvantage for the user that, due to the fact that they are free running, that is to say they can go anywhere, a number of possibilities of playing with them are not realisable.

It is an object of the present invention to remove these disadvantages and to provide a lap counter for radio controlled vehicles which can reliably measure the number of laps run by a vehicle round a track despite the fact that such vehicles have no fixed lateral position on the track.

SUMMARY OF THE INVENTION

According to the present invention a lap counter for radio vehicles includes two edge members together defining a convergent track, at least one counting device situated adjacent at least one of the edge members, with each counting device including at least two counting stations each having an indicator adapted to indicate the number of laps run by a vehicle and an actuator member operatively coupled to the indicator, each actuator member extending transversely to the convergent track and adapted to be contacted by a trigger member carried by a vehicle. Preferably the actuating members of each counting device are arranged at different heights.

Thus in the lap counter in accordance with the invention the vehicles must drive through a narrowed portion of the track or chicane. The pilot or "driver" must therefore steer his vehicle around certain obstacles within the framework of the predetermined route or track and then drive past the lap counter once per lap. The counting device is integrated in a predetermined portion of the race track as is the case of larger race tracks.

The vehicle is orientated to a certain extent on driving through the lap counter, which is effected by the edge members which converge. The vehicle now adopts a clearly defined position with respect to the lap counter. On at least one side of the vehicle a trigger member is secured. The trigger member extends beyond the external contour of the vehicle and conveniently comprises elastic material or a spring so that it does not suffer any damage when contacting a solid obstacle. The trigger member is mounted on the vehicle at a precisely predetermined height and extends above one of the edge members. At the lap counter the trigger member contacts an actuating member which is associated with this vehicle. The actuating member actuates the associated counting station and switches this by one unit.

It is possible to accommodate the trigger member at different heights on different vehicles. The edge members are disposed so that the trigger member of each vehicle will contact its associated actuating member when it drives through the lap counter. In a preferred embodiment the lap counter is provided with two counting stations.

Preferably each counting station includes a first toothed wheel connected to a second toothed wheel by a reversing gear whereby the first and second toothed wheels rotate at the same speed but in opposite directions, and two rotary indicators each associated with one of the first and second toothed wheels and arranged on opposite sides of the counting device so that when each indicator of each counting station is viewed they appear to rotate in the same direction. Thus an indicator situated on the rear side of the counting device, e.g. on a lap counter column moves in the same apparent direction of rotation as that on the front side. This is particularly convenient when a counting device is provided on both sides of the convergent portion of track. The indicators of the counting stations are thus identical on the front and rear sides. Thus the indicators of the counting stations preferably have the same direction of rotation when viewed from the front and rear sides. Since one indicator is thus visible from one side and the other on the other side the driver can easily follow the movement of the indicator.

The vehicles are preferably provided with a receiving device in the region of their chassis for the reception of a trigger member on each side. Since at least two different heights are available for the trigger members four different vehicles can be counted if two counting devices with two counting stations each are present. The trigger members of the four vehicles may be present as follows: right hand—left low, left high—right low.

In the preferred embodiment each actuating member is rotatably mounted about an axis. An actuator cam is situated on the axis which acts on a slider. A return spring is associated with the actuating members to return them to the neutral position. The slider is also equipped with a return spring and engages a spiked wheel by means of two spikes. Thus each time a counting station is triggered by a vehicle the associated spiked wheel is moved further by one unit. There is preferably also a toothed wheel connected to the spiked wheel which engages with another toothed wheel via a reversing gear comprising, for instance, two pinion wheels. The toothed wheels are mounted on respective shafts on each of which an indicator is set.

Further features and details of the invention will be apparent from the following description of certain specific embodiments which is given by way of example with reference to the accompanying diagrammatic drawings.

DESCRIPTION OF THE PREFERRED EMBODIMENT

Figure 1:
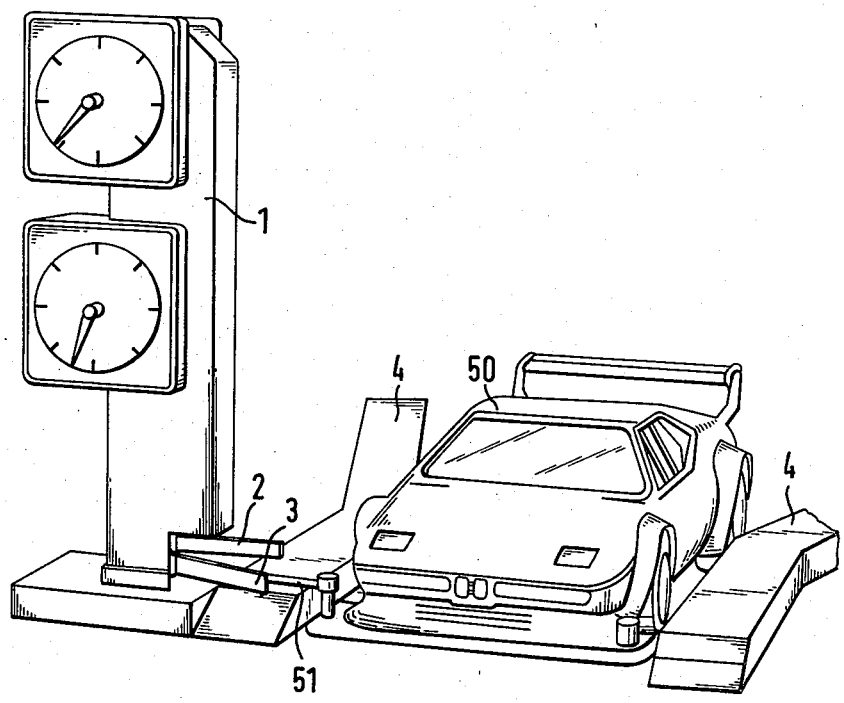
FIG. 1 is a perspective view of a lap counter in accordance with the invention with a single counting device.

FIG. 1 shows a lap counter including two edge members 4 which are so shaped that they define a convergent portion of track followed by a parallel sided portion of track adjacent which is a counting device 1 including two counting stations 1'. Associated with each counting station is a respective actuating member 2, 3 which extend above the adjacent edge member 4 transverse to the track defined between the edge members 4. The space between the two edge members is slightly greater than that of a radio controlled toy vehicle 50. The vehicle is provided with a trigger member 51 extending laterally beyond its framework and positioned so that it will contact one of the actuating members 2 or 3 once the vehicle has entered between and thus been orientated by the edge members 4.

Figure 2:
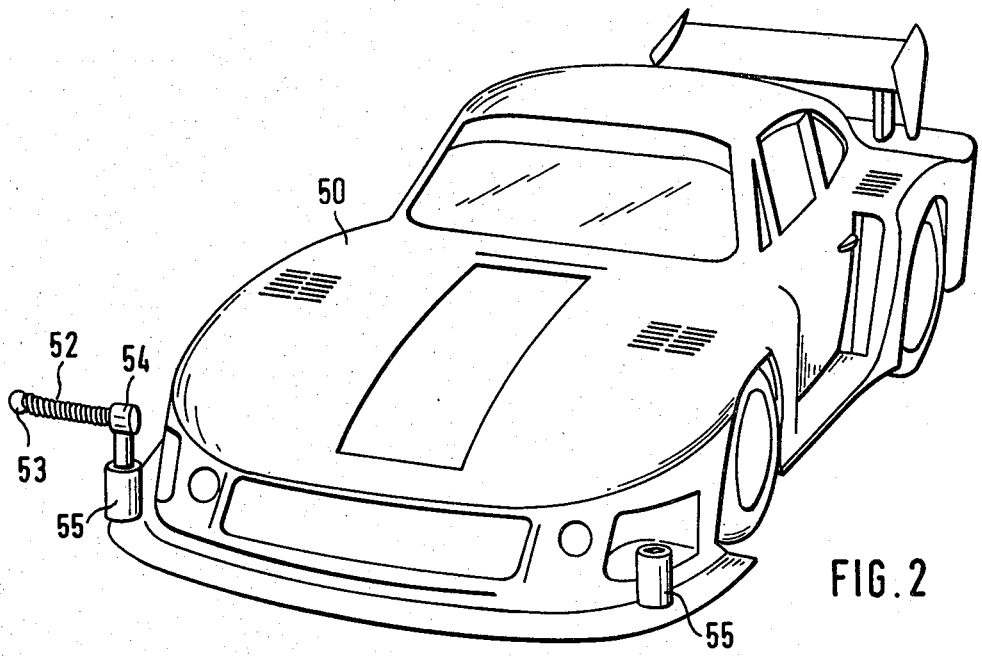
FIGS. 2 and 3 are perspective views of a toy vehicle having a trigger member set at different heights.
Figure 3:
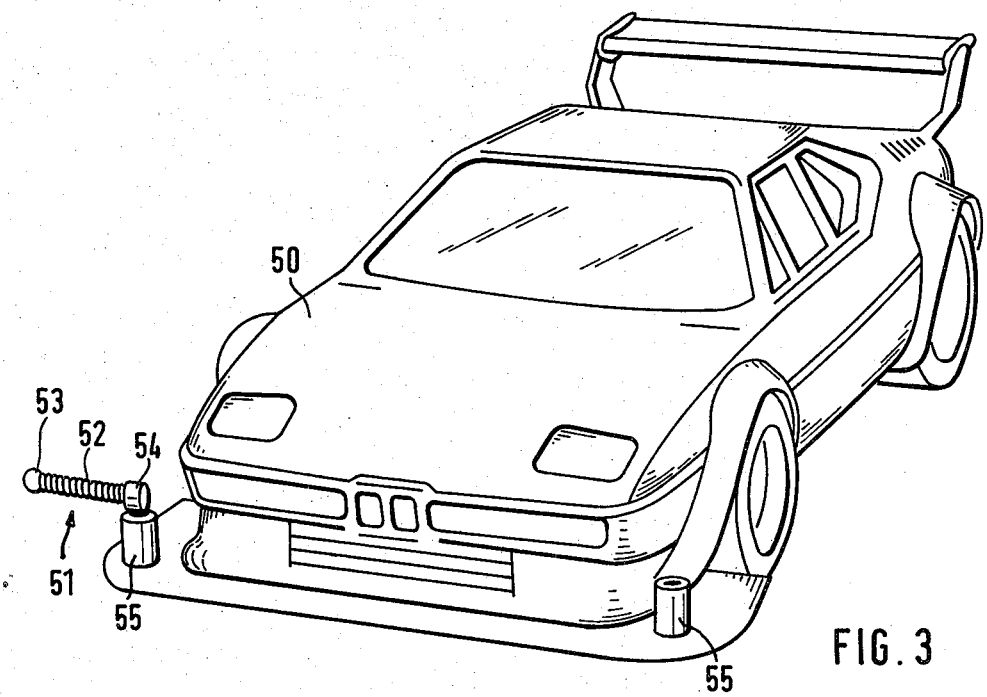
Figure 4:
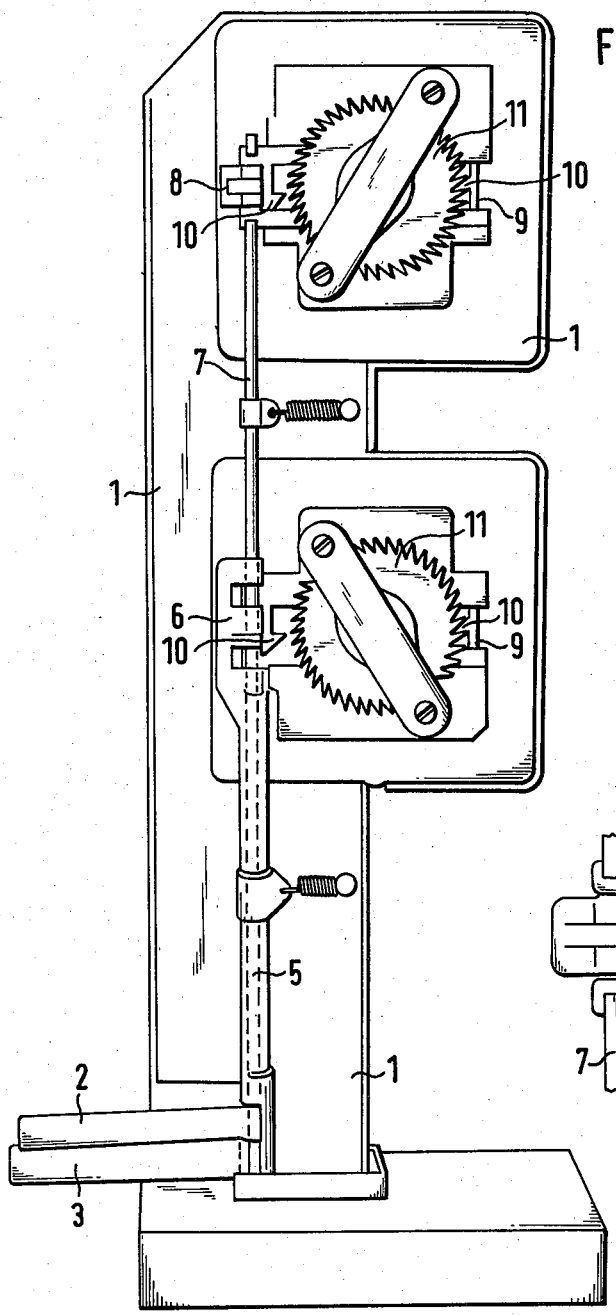
FIG. 4 is an elevation, partly in section of a single counting device.
Figure 5:
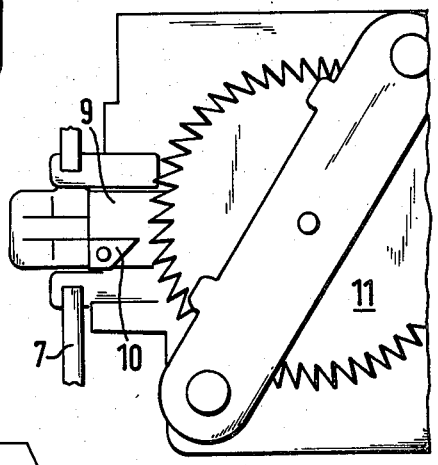
FIG. 5 is an enlarged view of part of a counting station.
Figure 6:
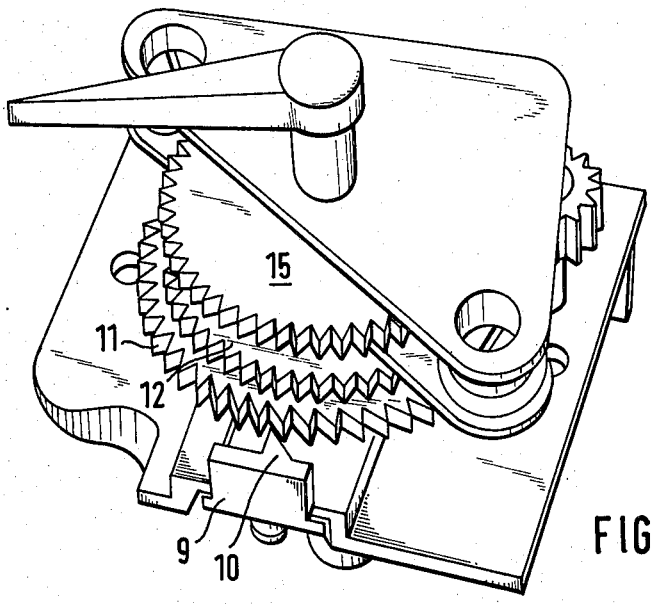
FIG. 6 is a perspective view of a counting station.
Figure 7:
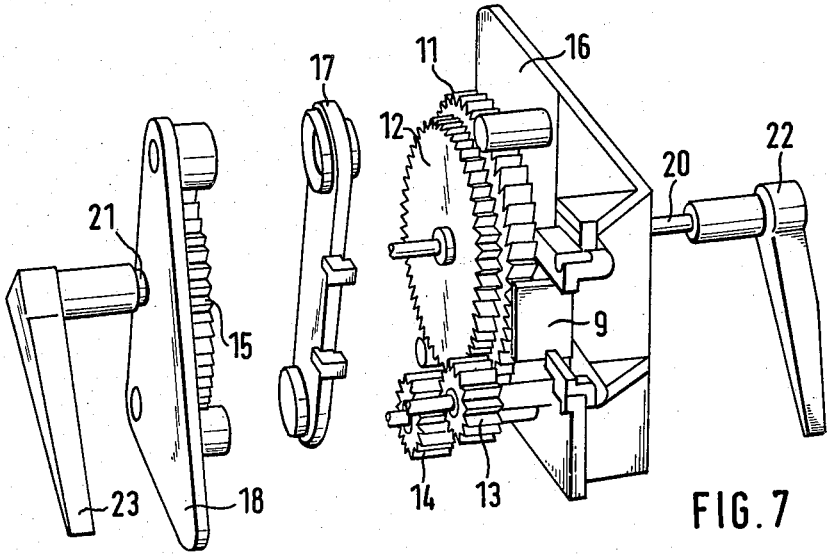
FIG. 7 is an exploded perspective view of a counting station.

FIGS. 2 and 3 show two different vehicles 50. The trigger member 51 comprises a coil spring 52 in these exemplary embodiments. The coil spring 52 has an end member 53, e.g. a ball at its free end, whilst it is held at the other end by a receiving portion 54 carried by the vehicle. The receiving portion 54 has a four sided projection which is received as a push fit in a hollow projection 55. The receiving portion 54 has an appropriate height so that a differentiation between two different receiving portions and thus two different vehicles is possible. The trigger member of the vehicles in FIGS. 2 and 3 are set at different heights and will thus contact different actuating members of the lap counter.

FIGS. 4 to 7 show the construction of a counting device 1. It comprises two counting stations 1' each of which is associated with a respective actuating member 2 or 3. The actuating members extend horizontally above the associated edge member and may or may not extend above the space defined by the edge members depending on the construction of the vehicles and their trigger members. The actuating member 3 is connected to a vertically extending hollow pivotable sleeve 5 at the upper end of which is an actuating cam 6. The actuating member 2 is similarly connected to a shaft 7 which extends within the sleeve 5 and at whose upper end is an actuating cam 8. Associated with the cams 6 and 8 is a respective slider 9 which carries two opposed spikes 10 which cooperate with a rotatable spiked wheel constructed in the manner of a ratchet or escapement wheel. If either of the actuating members is contacted by a trigger member its associated shaft 5 or 7 is rotated and this rotation is converted into linear movement of the respective slider 9 by the cam 6 or 8 and the respective spiked wheel 11 is rotated by one unit. The actuating members are returned to their neutral position by return springs 32 and the sliders by further return springs, which are not shown.

Each spiked wheel 11 is carried on a shaft 20 on which a toothed wheel 12 is also carried so that the wheels 11 and 12 rotate together. The wheel 12 is engaged by a pinion wheel 13 which is engaged by a pinion wheel 14 which in turn engages further toothed wheel 15 mounted on a shaft 21. The pinion wheels 13 and 14 constitute a reversing gear so that the wheels 12 and 15 rotate at the same speed but in opposite directions. Cooperating housing or bearing portions 16, 17 and 18 are provided to locate the various components of each counting station in the desired relative dispositions. The shafts 20 and 21 carry respective indicator arms 22 and 23 which rotate over respective indicator faces on opposite directions, but due to the fact that they are also viewed from opposite directions they appear to rotate in the same sense. Thus the two indicators of each counting station rotate in the same perceived sense and thus can be used to indicate the number of laps covered by a vehicle to an observer at nearly any position.

Figure 8:
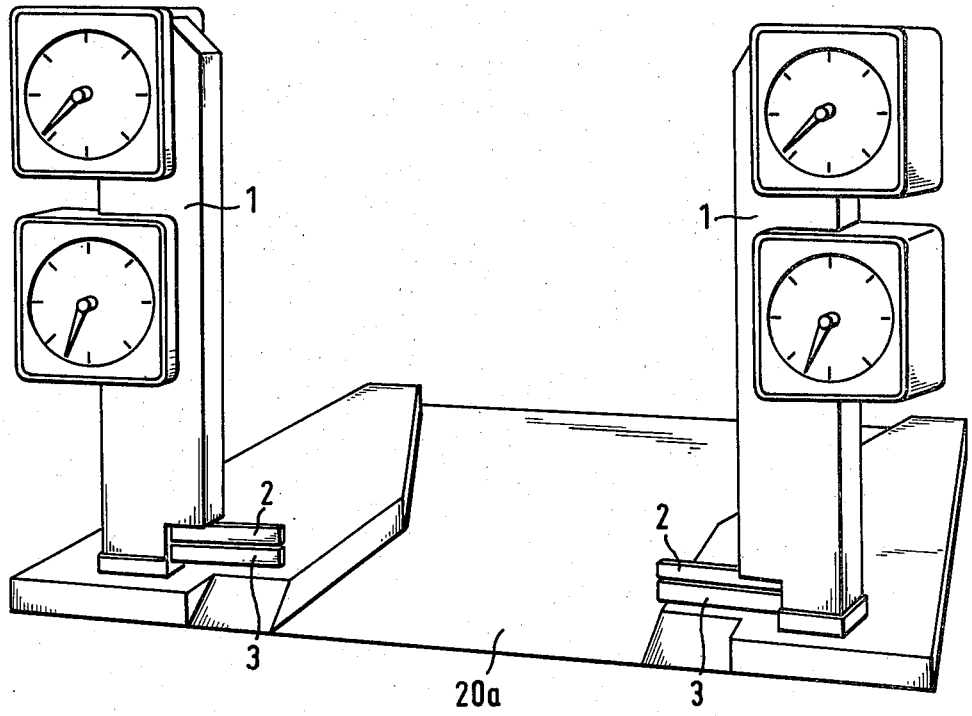
FIG. 8 is a view similar to FIG. 1 showing a lap counter with two counting devices.

FIG. 8 shows a modified embodiment in which the edge members 4 are secured to a common base 24 as are two counting devices 1, one on each side of the convergent track defined by the edge members, so that the lap counter constitutes a single constructional unit. Each counting device has two counting stations each of which has an actuating member associated with it and two indicators on opposite sides of the lap counter columns connected by a reversing gear, as described above. The counting devices or lap counter columns are symmetrically constructed so that they appear identical from the front and back. It will be appreciated that with this construction it is possible to count the laps run by four separate vehicles with appropriately positioned trigger members.

What I claim as my invention and desire to secure by Letters Patent is:

1. A lap counter for radio controlled vehicles, comprising two spaced edge members defining a convergent track, at least one counting device situated adjacent at least one of said edge members, each said counting device including at least two counting stations, each said counting station having an indicator adapted to indicate the number of laps run by a vehicle and an actuator member operatively coupled to said indicator, each said actuator member extending transversely to said convergent track and adapted to be contacted by a trigger member carried by a vehicle, each said counting station including a first toothed wheel, a second toothed wheel and a reversing gear, said reversing gear being arranged such that first and second toothed wheels rotate at the same speed but in opposite directions, each said counting station further including two rotary indicators, each said rotary indicator being associated with one of said first and second toothed wheels and being arranged on opposite sides of said counting device, whereby when each said indicator of each said counting station is viewed they appear to rotate in the same direction.

2. A lap counter as claimed in claim 1 wherein said actuating members of each said counting device are arranged at different heights.

3. A lap counter as claimed in claim 1 including a common base member, said edge member being secured to said common base member.

4. A lap counter as claimed in claim 1 including a shaft connecting each said actuating member to its respective said indicator, said shafts of each said counting device being arranged coaxially.

5. A lap counter as claimed in claim 1 said vehicle including a substantially horizontally extending trigger member adapted to contact an actuator member of said lap counter to thereby advance an associated said indicator to indicate that an additional lap has been driven by said vehicle.

* * * * *